US011701673B2

(12) United States Patent
Shin

(10) Patent No.: US 11,701,673 B2
(45) Date of Patent: Jul. 18, 2023

(54) ROBOTIC FOUNTAIN

(71) Applicant: Kunsoo Shin, Seoul (KR)

(72) Inventor: Kunsoo Shin, Seoul (KR)

( * ) Notice: Subject to any disclaimer, the term of this patent is extended or adjusted under 35 U.S.C. 154(b) by 368 days.

(21) Appl. No.: 17/256,757

(22) PCT Filed: Jun. 26, 2019

(86) PCT No.: PCT/KR2019/007714
§ 371 (c)(1),
(2) Date: Dec. 29, 2020

(87) PCT Pub. No.: WO2020/004928
PCT Pub. Date: Jan. 2, 2020

(65) Prior Publication Data

US 2021/0283624 A1 Sep. 16, 2021

(30) Foreign Application Priority Data

Jun. 29, 2018 (KR) ..... 10-2018-0075692
Jul. 3, 2018 (KR) ..... 10-2018-0077276

(51) Int. Cl.
*B05B 3/02* (2006.01)
*B05B 15/65* (2018.01)
*B05B 17/08* (2006.01)

(52) U.S. Cl.
CPC ..... *B05B 3/026* (2013.01); *B05B 15/65* (2018.02); *B05B 17/08* (2013.01)

(58) Field of Classification Search
CPC ..... B05B 3/026; B05B 15/65; B05B 17/08
USPC ..... 239/16, 17, 279, 285
See application file for complete search history.

(56) References Cited

U.S. PATENT DOCUMENTS 6,053,423 A * 4/2000 Jacobsen ..... B05B 17/08 239/18

FOREIGN PATENT DOCUMENTS

| | | | |
|---|---|---|---|
| KR | 20-0407331 | Y1 | 1/2006 |
| KR | 20-0428674 | Y1 | 10/2006 |
| KR | 10-0924802 | B1 | 11/2009 |
| KR | 10-2013-0022614 | A | 3/2013 |
| KR | 10-1667213 | B1 | 10/2016 |

OTHER PUBLICATIONS

International Search Report dated Oct. 18, 2019 in corresponding International application No. PCT/KR2019/007714; 4 pages.

* cited by examiner

*Primary Examiner* — Christopher S Kim
(74) *Attorney, Agent, or Firm* — Maier & Maier, PLLC

(57) ABSTRACT

A robotic fountain is proposed. The robotic fountain includes: a water supply pipe rotating while passing through upper and lower surfaces of a main body of the fountain; a fastening part formed between the lower surface of the main body and a lower end of the water supply pipe; a first motor configured to rotate the water supply pipe; a support part formed between the upper surface of the main body and an upper end of the water supply pipe; a bypass body fastened to the top of the water supply pipe; a through hole formed through one side of a lower surface of a rotary body, the rotary body fastened to an upper surface of the bypass body; an intermediate pipe configured to rotate inside the rotary body; a second motor for rotating the intermediate pipe; and a nozzle formed at the center of the intermediate pipe.

9 Claims, 11 Drawing Sheets

ROBOTIC FOUNTAIN

TECHNICAL FIELD

The present disclosure relates to a robotic fountain and, more particularly, to a robotic fountain, which has a rotary body rotatably provided on an upper portion of a main body, and a nozzle configured to rotate perpendicularly to a rotating direction of the rotary body, thereby having a simple structure, being easy to be assembled and disassembled, and being capable of reducing manufacturing, installation, maintenance costs and creating a fountain of various patterns.

BACKGROUND

In recent year, musical fountains, which create a scene as if a plurality of fountains dances by installing the fountains to be individually operated by following sound signals in accordance with music, have become popular. In addition, various attempts are being made such fountains, for example, a ground fountain installed along various patterns arranged on the ground to provide a space for children to experience the fountain with their whole body while directly being splashed by water sprayed from the fountain.

However, even when the plurality of fountains is installed and each of the fountains is individually operated by following sound signals, each of the fountains only rotates or swings in one direction, and does not make various shaped water streams that create an aesthetic sense.

In Korean patent No. 10-0500580, which is registered in the past by the inventor, the nozzle of a fountain can swing at an angle of 180° while rotating at an angle of 360°, thereby creating various water spray patterns.

However, in the above related art, it is not easy to assemble and disassemble the fountain, and even when water permeates a main body and a rotary body, the water leakage cannot be detected.

SUMMARY

The present disclosure has been made keeping in mind the above problems occurring in the related art, and the present disclosure is intended to propose a robotic fountain, which includes a water supply pipe, a bypass body, an intermediate body, a nozzle, and a fastening part that protrudes downward from a lower surface of a main body of the fountain, thereby having a simple structure, being easy to be assembled and disassembled, and reducing manufacturing, installation, and maintenance costs and creating a fountain of various patterns.

Another objective of the present disclosure is to provide a robotic fountain, which has a leak sensor provided in at least one of a main body and a rotary body to detect water leakage into the main body and the rotary body, a support part between the main body and a water supply pipe to secure rotating stability of the fountain and to easily perform assembly and disassembly, and a wire hole on a main part to prevent wires from twisting.

According to the present disclosure achieving the above objectives, there is provided a robotic fountain. The robotic fountain, which includes a main body, a rotary body rotatably positioned on an upper portion of the main body, and a nozzle configured to rotate in a direction perpendicular to a rotating direction of the rotary body, includes: a water supply pipe configured to rotate while passing through upper and lower surfaces of the main body; a fastening part positioned between the lower surface of the main body and a lower end of the water supply pipe, the fastening part protruding downward from the lower surface of the main body, and having a "U"-shaped section; a first motor provided in the main body, and configured to rotate the water supply pipe; a support part provided between the upper surface of the main body and an upper end of the water supply pipe, and having a "Π"-shaped section; a bypass body fastened to the upper end of the water supply pipe, and having a bypass passage communicating with the water supply pipe; a through hole formed through one side of a lower surface of to the rotary body such that when the rotary body is fastened to an upper surface of the bypass body, the through hole communicates with the bypass passage; an intermediate pipe configured to rotate in the rotary body and having a first end communicating with the through hole; a second motor provided in the rotary body and connected to a second end of the intermediate pipe to rotate the intermediate pipe; and the nozzle provided in a center portion of the intermediate pipe.

Bearings may be provided between the water supply pipe and the fastening part, between the water supply pipe and the support part, and between the rotary body and the intermediate pipe, respectively.

A leak sensor may be provided in one side in the main body or the rotary body, and the leak sensor may be fastened to a "⊂"-shaped bracket.

A slip ring may be provided on an outside surface of the water supply pipe, a main part having a "Π"-shaped section may be provided on the upper end of the water supply pipe, and a wire hole may be vertically formed through the main part, the wire hole being also formed by extending to the bypass body coupled to an upper end of the main part, and being also formed by extending to the rotary body coupled to an upper end of the bypass body.

A connection shaft coupled to the second motor may be provided on the second end of the intermediate pipe, and a flange may be formed on each of the upper end and a lower end of the bypass body.

The rotary body may be divided into a first rotary body and a second rotary body, the intermediate pipe may be positioned in the first rotary body, and the connection shaft, a reducer, and the second motor may be positioned in the second rotary body.

According to the present disclosure, the robotic fountain includes the water supply pipe, the bypass body, the intermediate body, the nozzle, and the fastening part protruding downward from a lower surface of the main body. Therefore, the structure thereof is simple and assembly and disassembly thereof are easily performed, thereby being capable of reducing manufacturing, installation, and maintenance costs, and creating a fountain of various patterns.

Furthermore, the leak sensor is provided in at least one of the main body and the rotary body so that water leakage can be detected in advance, the support part is provided between the main body and the water supply pipe so that rotating stability of the fountain can be secured and the assembly and disassembly thereof can be easily performed, the wire hole is formed on the main part of the main body so that the wires can be prevented from twisting, and a plurality of robotic fountains are connected to each other by a network so that various fountain can be produced.

DETAILED DESCRIPTION OF THE EMBODIMENTS

Figure 1:
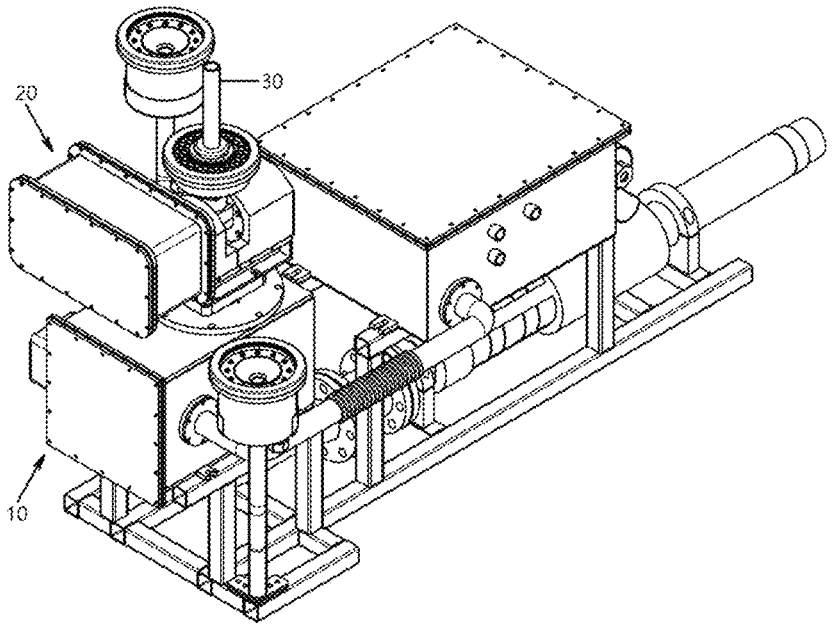
FIG. 1 is a left-side perspective view showing a robotic fountain according to the present disclosure.
Figure 2:
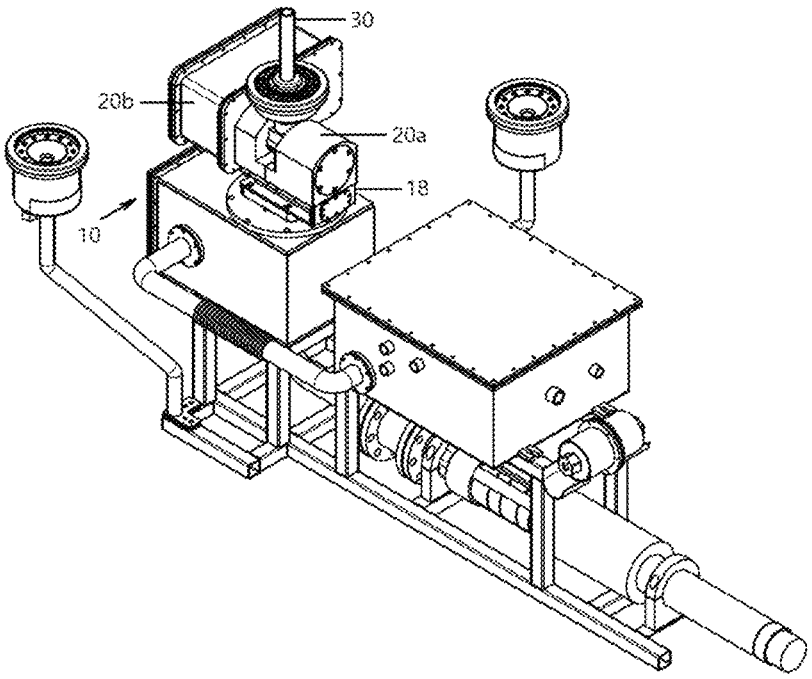
FIG. 2 is a right-side perspective view showing the robotic fountain according to the present disclosure.
Figure 3:
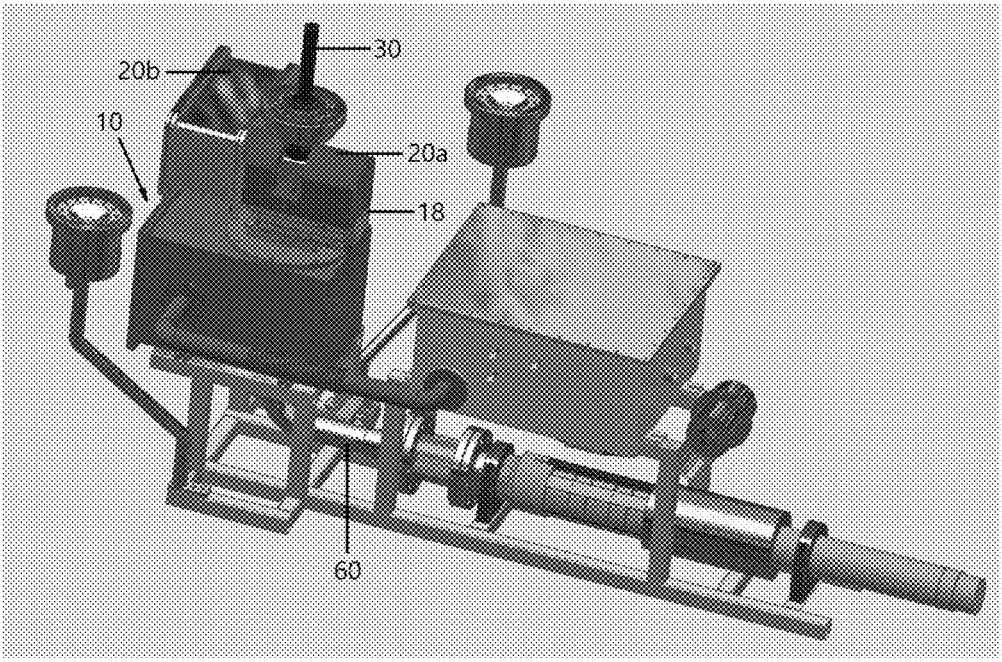
FIG. 3 is a 3D perspective view showing the robotic fountain according to the present disclosure.
Figure 4:
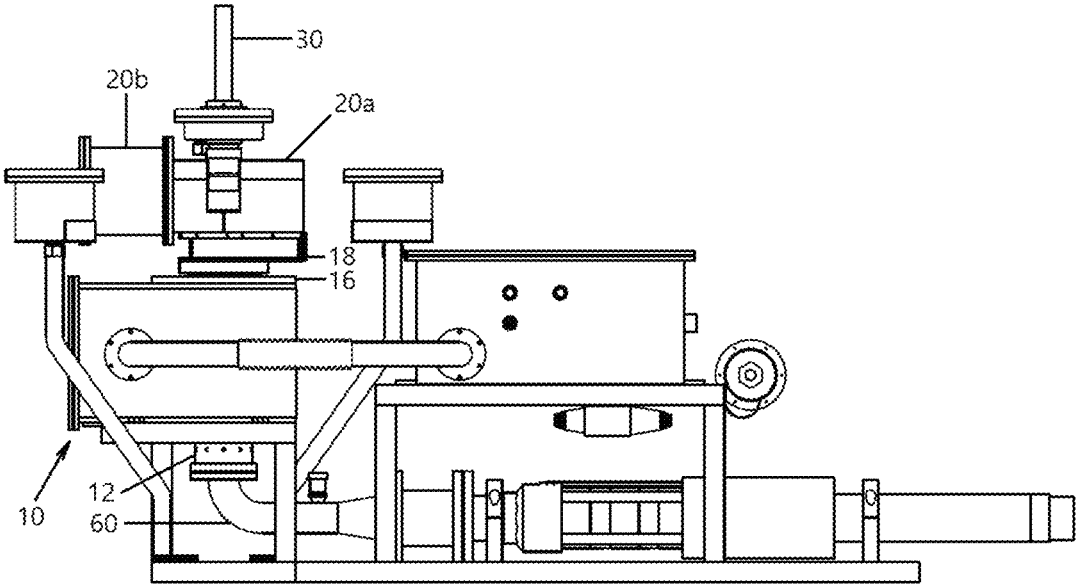
FIG. 4 is a front view showing the robotic fountain according to the present disclosure.
Figure 5:
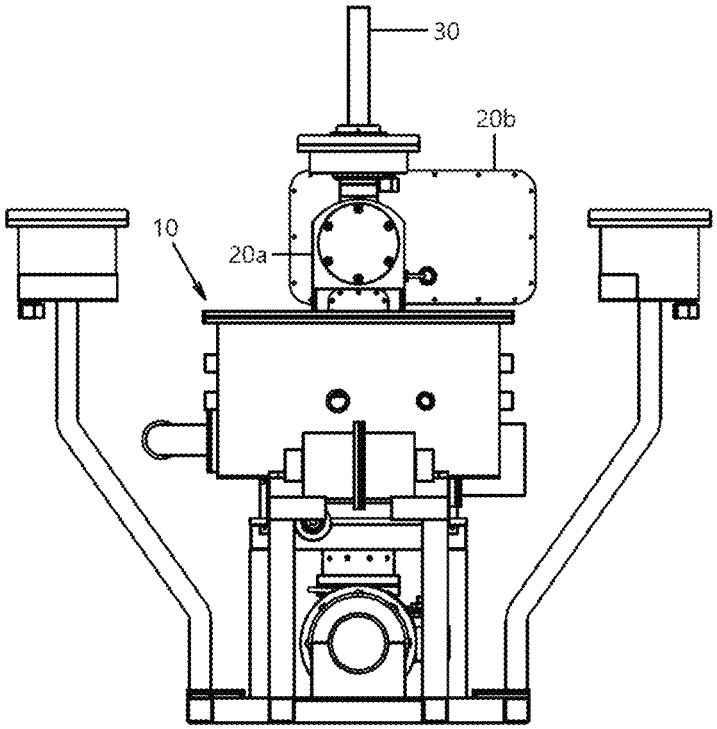
FIG. 5 is a right side view showing the robotic fountain according to the present disclosure.
Figure 6:
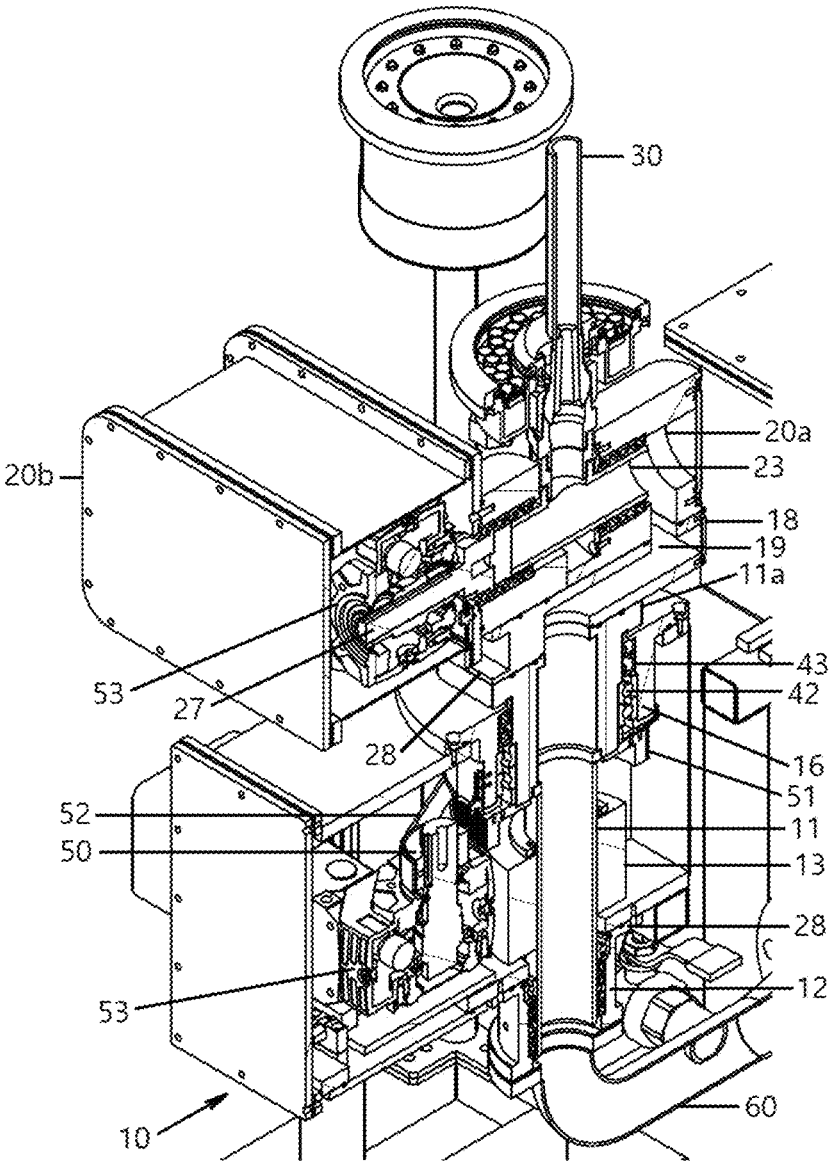
FIG. 6 is a partially sectional perspective view showing the robotic fountain according to the present disclosure.

According to the present disclosure, a robotic fountain, which includes a main body 10, a rotary body 20 rotatably positioned on an upper portion of the main body 10, and a nozzle 30 configured to rotate in a direction perpendicular to a rotating direction of the rotary body 20, includes: a water supply pipe 11 configured to rotate while passing through upper and lower surfaces of the main body 10; a fastening part 12 positioned between the lower surface of the main body 10 and a lower end of the water supply pipe 11, protruding downward from the lower surface of the main body 10, and having a "U"-shaped section; a first motor 14 provided in the main body 10, and configured to rotate the water supply pipe 11; a support part 16 provided between the upper surface of the main body 10 and an upper end of the water supply pipe 11, and having a "Π"-shaped section; a bypass body 18 fastened to the upper end of the water supply pipe 11, and having a bypass passage 19 communicating with the water supply pipe 11; a through hole 21 formed through one side of a lower surface of to the rotary body 20 such that when the rotary body 20 is fastened to an upper surface of the bypass body 18, the through hole 21 communicates with the bypass passage 19; an intermediate pipe 23 configured to rotate in the rotary body 20 and having a first end communicating with the through hole 21; a second motor 24 provided in the rotary body 20 and connected to a second end of the intermediate pipe 23 to rotate the intermediate pipe 23; and the nozzle 30 provided in a center portion of the intermediate pipe 23, wherein water supplied to the water supply pipe 11 flows through the bypass passage 19, the through hole 21, and the intermediate pipe 23 to be sprayed through the nozzle 30.

According to the present disclosure, the robotic fountain includes the main body 10, the bypass body 18, the rotary body 20, and the nozzle 30, and the main body 10 includes the water supply pipe 11, the fastening part 12, the first motor 14, and the support part 16, and the rotary body 20 in which the through hole 21 is formed at one side of the lower surface thereof includes the intermediate pipe 23 and the second motor 24.

Figure 7:
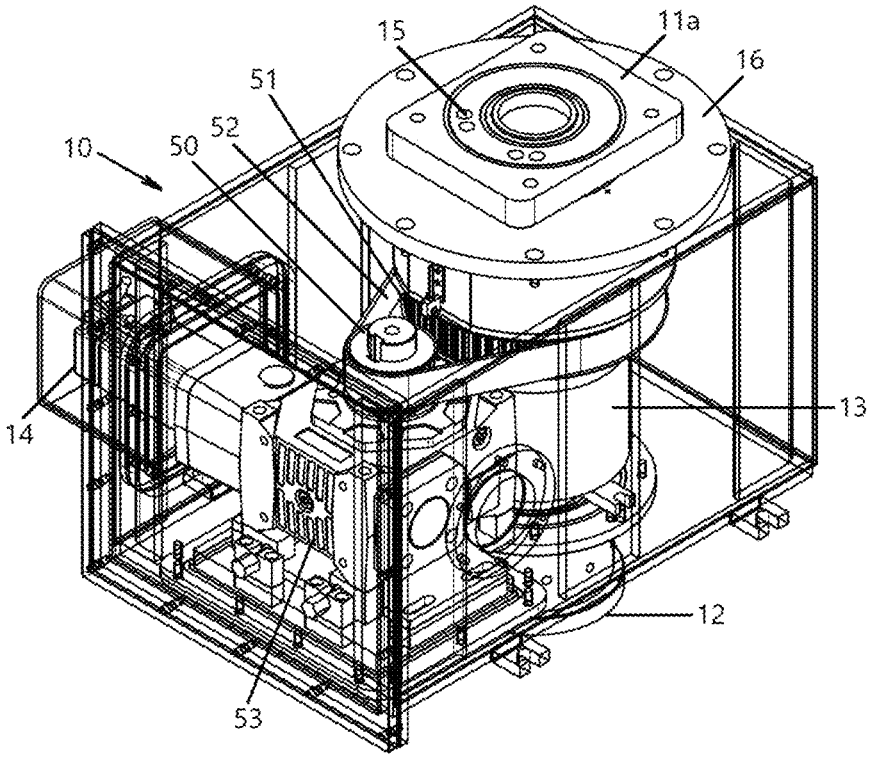
FIG. 7 is a perspective view showing a main body of the robotic fountain according to the present disclosure.
Figure 8:
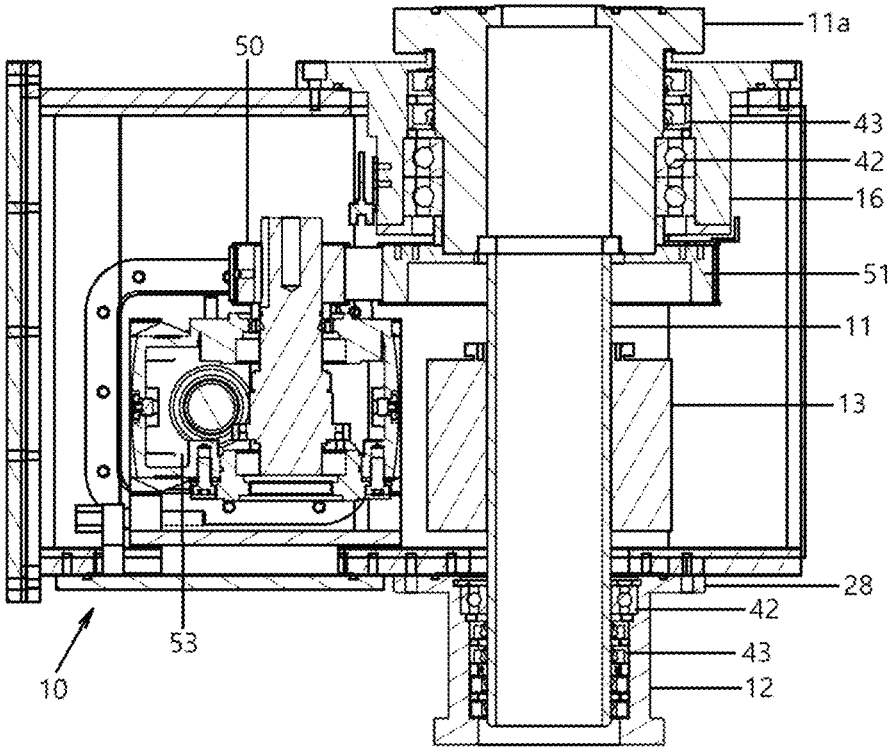
FIG. 8 is a section view showing the main body of the robotic fountain according to the present disclosure.
Figure 11:
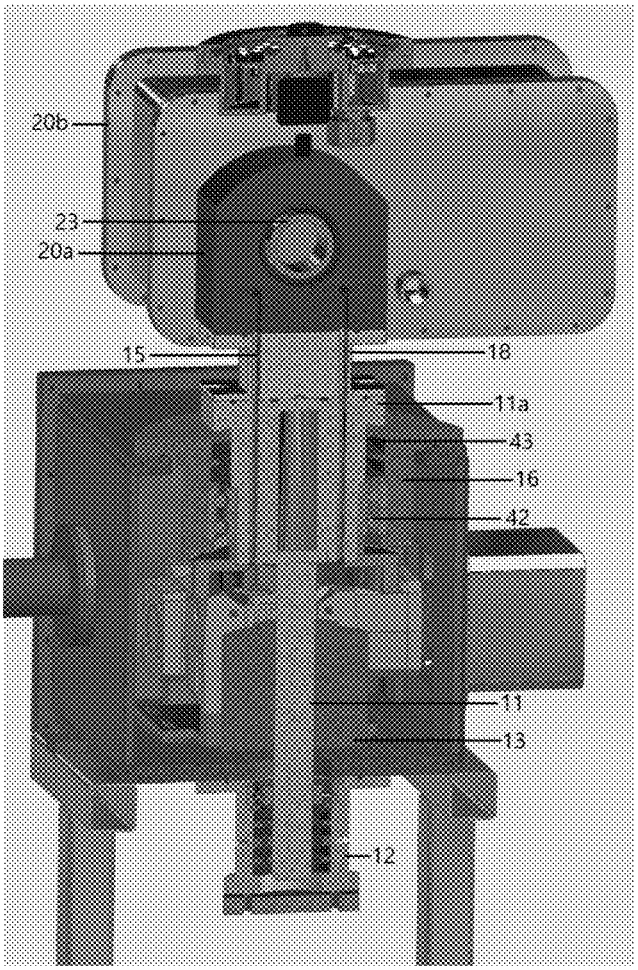
FIG. 11 is a partially sectional 3D perspective view showing the robotic fountain according to the present disclosure.
Figure 12:
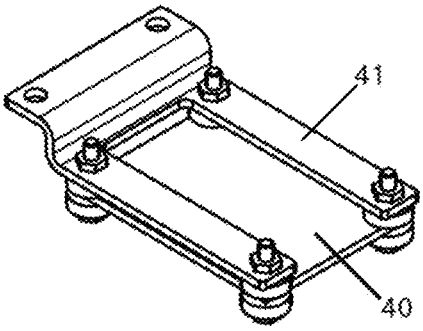
FIG. 12 is a perspective view showing a leak sensor and a bracket of the robotic fountain according to the present disclosure.

FIG. 7 is a perspective view showing the main body of the robotic fountain according to the present disclosure. FIG. 8 is a section view showing the main body of the robotic fountain according to the present disclosure. FIG. 11 is a partially sectional 3D-rendered perspective view showing a partial section of the robotic fountain according to the present disclosure. FIG. 12 is a perspective view showing a leak sensor and a bracket of the robotic fountain according to the present disclosure.

The water supply pipe 11 is provided in the main body 10 while passing through the upper and lower surfaces of the main body 10, and is rotatably supported by a bearing 42.

The fastening part 12 having the "U"-shaped section protrudes downward from the lower surface of the main body 10, and is provided between the lower surface of the main body 10 and the lower end of the water supply pipe 11. A lower surface of the fastening part 12 is coupled to a water pipe 60, and a center portion of the lower surface of the fastening part 12 has a vertical hole, so that water supplied from the water pipe 60 is supplied to the water supply pipe 11. In addition, the bearing 42 is provided between the water supply pipe 11 and the fastening part 12, at least one seal 43 is provided at a lower portion of the bearing 42 provided between the water supply pipe 11 and the fastening part 12, a flange 28 is formed on an upper end of the fastening part 12, and the fastening part 12 is coupled to the lower surface of the main body 10 due to the flange 28. As the fastening part 12 protrudes downward from the lower surface of the main body 10, not only space in the main body 10 may be secured, but also a plurality of seals 43 may be arranged in a vertical direction without loss of space. Therefore, water leakage into the main body 10 does not occur.

The support part 16 having the "Π"-shaped section is provided between the upper surface of the main body 10 and the upper end of the water supply pipe 11. The support part 16 is fastened to the main body 10 by being inserted downward from the upper surface of the main body 10. A center portion of an upper surface of the support part 16 has a vertical hole so that the water supply pipe 11 is inserted thereinto, the bearing 42 is provided the water supply pipe 11 and the support part 16, and at least one seal 43 is provided at an upper portion of the bearing 42.

A main part 11*a* having a "Π"-shaped section is integrally coupled to the upper end of the water supply pipe 11 so that the bearing 42 is provided between the main part 11*a* and the support part 16, and at least one seal 43 is provided on the upper portion of the bearing 42 provided between the main part 11*a* and the support part 16.

A slip ring 13 is provided on an outside surface of a lower portion of the water supply pipe 11 to stably supplies power and signals to the rotary body 20 without twisting wires. A wire hole 15 is vertically formed through the main part 11*a*, is also formed by extending to the bypass body 18 coupled to an upper end of the main part 11*a*, and is also formed by extending to is formed by extending to the rotary body 20 coupled to an upper end of the bypass body 18. The wires extending from the slip ring 13 pass through the wire hole 15 formed on the main part 11*a*, the bypass body 18, and the rotary body 20, and then extend into the rotary body 20. Therefore, the wires are prevented from twisting even when the water supply pipe 11 and the rotary body 20 rotate.

The first motor 14 provided in the main body 10 rotates the water supply pipe 11, a driven pulley 51 is provided on an outside surface of the water supply pipe 11, and a shaft of the first motor 14 may be coupled to a shaft of the drive pulley 50 via a reducer 53 (rotating speed of the shaft may be reduced by various gear engagement methods, such as engagement of a worm gear, a bevel gear, etc., in the reducer), wherein the shaft of the drive pulley 50 is perpendicular to the shaft of the first motor 14. The drive pulley 50 and the driven pulley 51 may be connected to each other by a belt 52, and the pulleys 50 and 51 may be replaced by a gear, a sprocket, etc. In other words, the water supply pipe 11 and the first motor 14 may be coupled to each other by a gear, etc., like the intermediate pipe 23 and the second motor 24, which will be described below.

In the main body 10, the water supply pipe 11, the main part 11*a*, the first motor 14, the support part 16, the drive pulley 50, the driven pulley 51, the reducer 53 are positioned, and the fastening part 12 is positioned outside the lower surface of the main body 10.

The leak sensor 40 is provided in the main body 10 to detect water seeping into the main body 10. Preferably, the leak sensor 40 is mounted to a "⊂"-shaped bracket 41 and fixed on the bottom of the main body 10.

Figure 9:
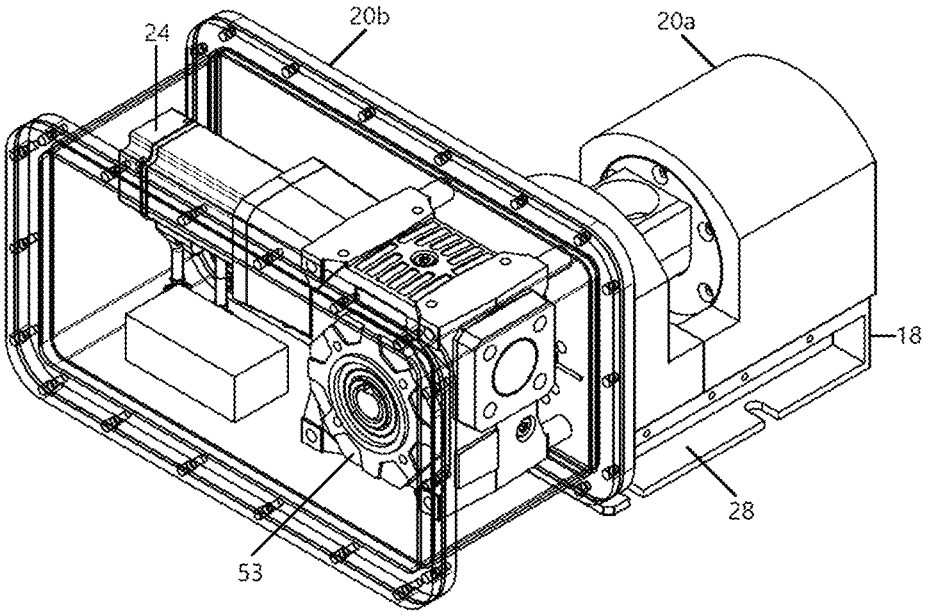
FIG. 9 is a perspective view showing a rotary body of the robotic fountain according to the present disclosure.
Figure 10:
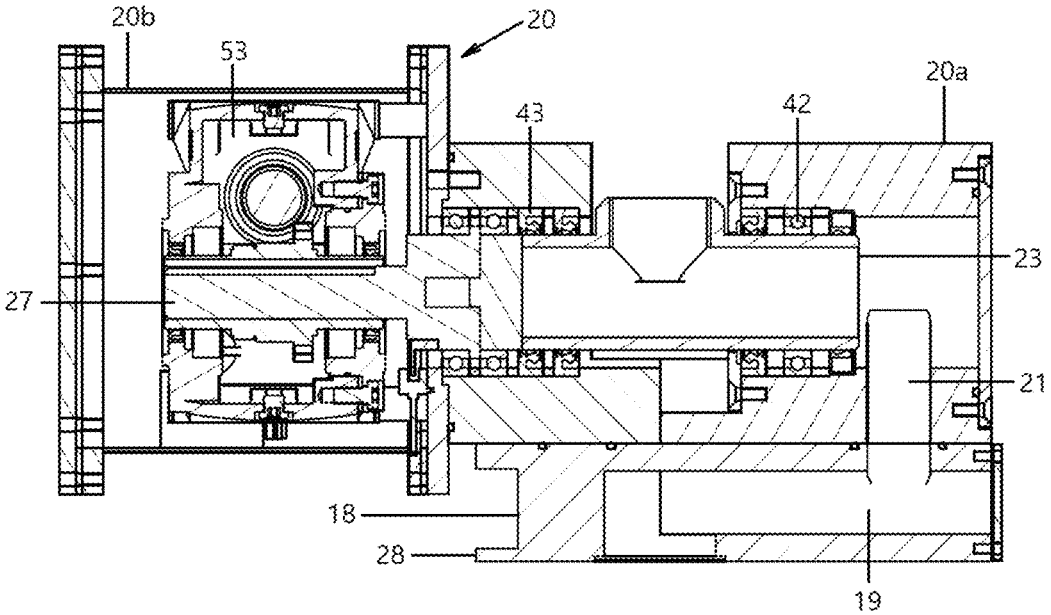
FIG. 10 is a section view showing the rotary body of the robotic fountain according to the present disclosure.

FIG. 9 is a perspective view showing the inside of the rotary body of the robotic fountain according to the present disclosure. FIG. 10 is a section view showing the rotary body of the robotic fountain according to the present disclosure. FIG. 11 is a 3D-rendered perspective view showing a partial section of the robotic fountain according to the present disclosure. FIG. 12 is a perspective view showing the leak sensor and the bracket of the robotic fountain according to the present disclosure.

The bypass passage 19 communicating with the water supply pipe 11 is formed in in the bypass body 18 fastened to the upper end of the water supply pipe 11. The bypass body 18 may be stably coupled to the main part 11*a* and the rotary body 20 due to the flange 28 formed on the upper end and the lower end of the bypass body 18.

The through hole 21 is provided on one side of the lower surface of the rotary body 20 so that the rotary body 20 communicates with the bypass passage 19. The rotary body 20 is coupled to the upper surface of the bypass body 18. A first end of the intermediate pipe 23, which is rotatable in a direction perpendicular to a rotating direction of the rotary body 20 in the rotary body 20, communicates with the through hole 21. At this time, the bearing 42 is provided between the rotary body 20 and the intermediate pipe 23, and the seal 43 is provided at one side or both sides of the bearing 42 provided between the rotary body 20 and the intermediate pipe 23.

The second motor 24 provided in the rotary body 20 is connected to a second end of the intermediate pipe 23 to rotate the intermediate pipe 23. Additionally, the second end of the intermediate pipe 23 may have a connection shaft 27, the shaft of the second motor 24 perpendicular to the connection shaft 27 may be coupled to each other via the reducer 53, wherein the rotating speed of the shaft may be reduced by various gear engagement methods, such as engagement of a worm gear, a bevel gear, etc., in the reducer. In addition, the intermediate pipe 23 and the second motor 24 may be coupled to each other by a pulley and a belt, like coupling between the water supply pipe 11 and the first motor 14.

The rotary body 20 may be divided into a first rotary body 20*a* and a second rotary body 20*b*. The intermediate pipe 23 may be positioned in the first rotary body 20*a*, and the connection shaft 27, the reducer 53, and the second motor 24 may be positioned in the second rotary body 20*b*.

The leak sensor 40 may be provided in the rotary body 20 and detects water seeping into the rotary body 20. Preferably, the leak sensor 40 is fastened to the "⊂"-shaped bracket 41 and fixed to the bottom of the rotary body 20.

The nozzle 30 is coupled to the center portion of the intermediate pipe 23, and LED lighting may be provided around the nozzle 30.

The wire hole 15 is also formed by extending to the bypass body 18 coupled to the upper end of the main part 11*a*. The wire hole 15 is also formed by extending to the first rotary body 20*a* coupled to the upper end of the bypass body 18. The wire hole 15 of the first rotary body 20*a* extending horizontally so that the wires may be connected to the second motor 24 positioned in the second rotary body 20*b*. Furthermore, the wires may be drawn out of one side of the second rotary body 20*b* to be connected to the LED lighting, and power and signals may be stably supplied to the LED lighting without twisting of the wires, even when the nozzle 30 rotates freely in various directions.

Water supplied to the water supply pipe 11 passes through the bypass passage 19, the through hole 21, and the intermediate pipe 23, and is sprayed through the nozzle 30. In other words, as the water supply pipe 11 rotates, the bypass body 18 coupled to the water supply pipe 11 rotates the rotary body 20 coupled to the bypass body 18. Even when the intermediate pipe 23 rotates in the direction perpendicular to the rotating direction of the water supply pipe 11 in the rotary body 20, the water supplied to the water supply pipe 11 may be sprayed through the nozzle 30, and the nozzle 30 spraying the water may be controlled to rotate in various directions, so that a beautiful fountain may be created.

Functions and actions of the robotic fountain according to the present disclosure will be described as follows with reference to FIGS. 1 to 12.

In the robotic fountain according to the present disclosure, for free rotation of the nozzle 30 in various direction, the rotary body 20 coupled to the bypass body 18 rotates together with the water supply pipe 11, the intermediate pipe 23 rotates in the direction perpendicular to the rotating direction of the rotary body 20 in the rotary body 20, and the nozzle 30 coupled to the intermediate pipe 23 also rotates. The water supplied to the water supply pipe 11 flows through the bypass passage 19, the through hole 21, and the intermediate pipe 23, and is sprayed through the nozzle 30. Accordingly, as the fastening part 12 protrudes downward from the lower surface of the main body 10, the plurality of seals 43 and the plurality of bearings 42 are provided in the vertical direction without loss of space, so that water leakage into the main body 10 may be prevented and rotation stability may be secured.

Furthermore, the leak sensor 40 is provided at one side in one of or both of the main body 10 and the rotary body 2 to detect water seeping into the main body 10 and/or the rotary body 20. The wires extending from the slip ring 13 pass through the main part 11*a*, the bypass body 18, and the wire hole 15 formed on the rotary body 20 to extend into the rotary body 20, so that the wires are prevented from twisting even in rotation of both the water supply pipe 11 and the rotary body 20. When the LED lighting is provided around the nozzle 30, the wires are drawn out of one side of the second rotary body 20*b* and connected to the LED lighting, so that the power and the signals may be stably supplied to the LED lighting in free rotation of the nozzle 30 in various directions.

Figure 13:
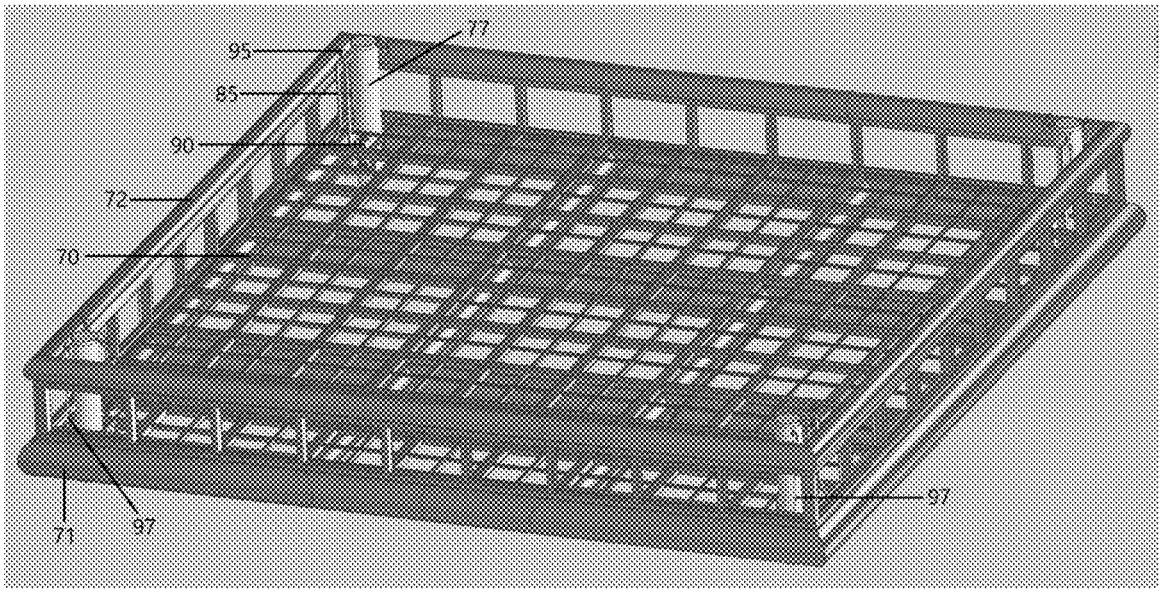
FIG. 13 is a 3D perspective view showing a submersible buoyancy body according to the present disclosure.
Figure 14:
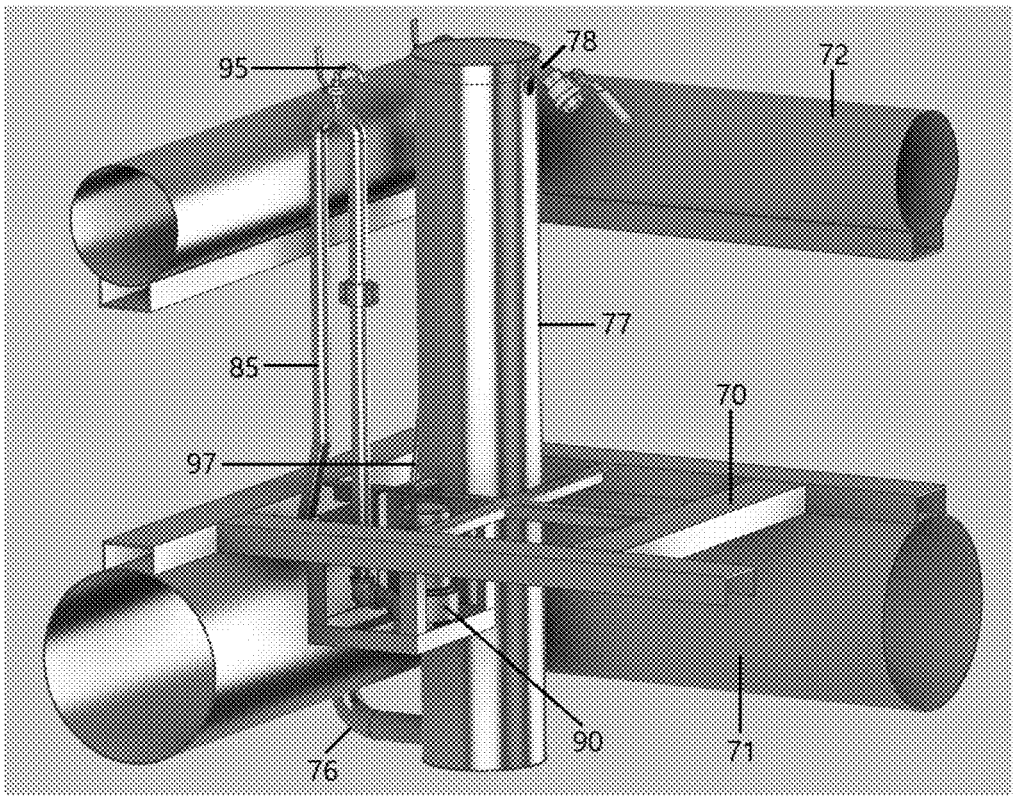
FIG. 14 is a partial 3D perspective view showing the submersible buoyancy body according to the present disclosure.
Figure 15:
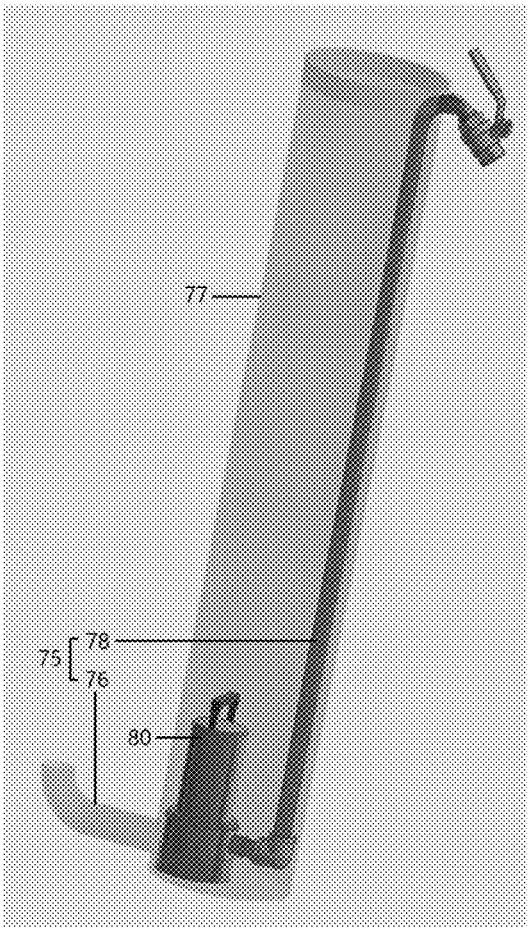
FIG. 15 is a 3D perspective view showing a drain part of the submersible buoyancy body according to the present disclosure.
Figure 17:
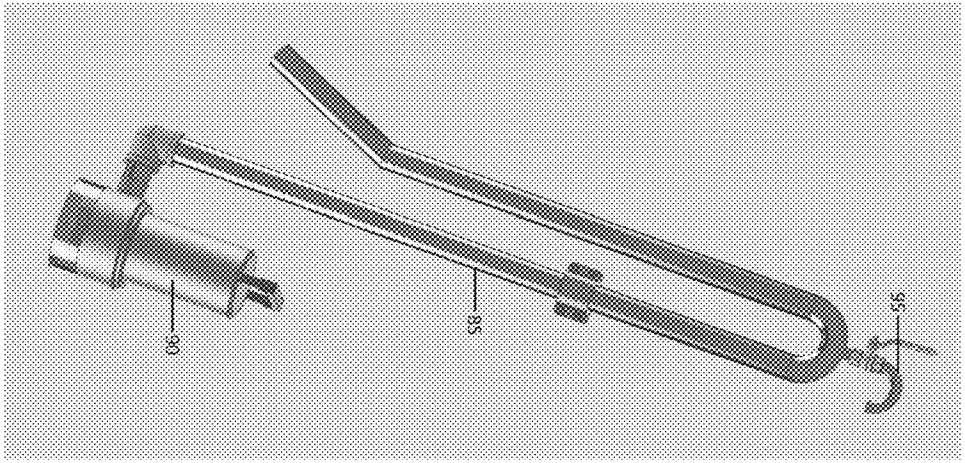
FIG. 17 is a 3D perspective view showing a water supply part of the submersible buoyancy body according to the present disclosure.

FIG. 13 is a 3D perspective view showing a submersible buoyancy body according to the present disclosure. FIG. 14 is a partial 3D perspective view showing the submersible buoyancy body according to the present disclosure. FIG. 15 is a 3D perspective view showing a drain part of the submersible buoyancy body according to the present disclosure. FIG. 17 is a 3D perspective view showing a water supply part of the submersible buoyancy body according to the present disclosure.

The robotic fountain according to the present disclosure includes the submersible buoyancy body. The submersible buoyancy body may include: a buoyancy pipe 71 fixed to a frame 70; a drain pipe 75 connected to a lower portion of the buoyancy pipe 71 and extending upward; a drain pump 80 provided on one side of a lower portion of the drain pipe 75 and draining water in the buoyancy pipe 71 to the outside through the drain pipe 75; a water supply pipe 85 having a first end coupled to an upper portion of the buoyancy pipe 71 and having a "∩" shape; a water supply pump 90 provided on a second end of the water supply pipe 85 and supplying water into the buoyancy pipe 71 through the water supply pipe 85; a stop part 95 provided on an upper portion of the water supply pipe 85 and stopping water supply into the buoyancy pipe 71 when the operation of the water supply pump 90 is stopped; and an air pipe 97 connected to the upper portion of the buoyancy pipe 71 and extending upward. Otherwise, the submersible buoyancy body includes: the buoyancy pipe 71 fixed to the frame 70; a first drain pipe 76 having a first end connected to the lower portion of the buoyancy pipe 71; a drain cylinder 77 to which a second end of the first drain pipe 76 is connected; the drain pump 80 positioned in the drain cylinder 77; a second drain pipe 78 positioned in the drain cylinder 77, and having a first end connected to the drain pump 80 and extending upward and a second end protruding to the outside from the drain cylinder 77; the water supply pipe 85 having the first end connected to the upper portion of the buoyancy pipe 71 and having the "∩" shape; the water supply pump 90 provided on the second end of the water supply pipe 85 and supplying water into the buoyancy pipe 71 through the water supply pipe 85; the stop part 95 provided on the upper portion of the water supply pipe 85 and stopping water supply into the buoyancy pipe 71 when the operation of the water supply pump 90 is stopped; and the air pipe 97 connected to the upper portion of the buoyancy pipe 71 and extending upward.

The submersible buoyancy body according to the present disclosure includes the buoyancy pipe 71, the drain part (the drain pipe 75 and the drain pump 80), the water supply part (the water supply pipe 85, the water supply pump 90, and the stop part 95), and the air pipe 97. Alternately, the submersible buoyancy body according to the present disclosure includes the buoyancy pipe 71, the drain part (the first drain pipe 76, the drain cylinder 77, the second drain pipe 78, and the drain pump 80), the water supply part (the water supply pipe 85, the water supply pump 90, and the stop part 95) and the air pipe 97.

The robotic fountain is installed on an upper surface of the submersible buoyancy body. The buoyancy pipe 71 is fixed to the frame 70 of the submersible buoyancy body, in detail, the frame 70 may have a rectangular shape in which metal beams are coupled to each other in a grid shape to create a sense of structural stability, the buoyancy pipe 71 may be provided at each of four edges of the rectangular frame 70, a perforated plate may be provided on an upper surface of the metal beams formed in the grid shape, and the shape of the rectangular frame 70 may be variously modified. An upper pipe 72 may be provided at the upper portion of the buoyancy pipe 71, and the inside of the upper pipe 72 may be filled with air or a floating body with a low specific gravity, such as Styrofoam.

The submersible buoyancy body uses the Archimedes' principle that when part or all of an object is submerged in a liquid, the weight and size of the liquid pushed out by the object are the same, and the buoyant force in the opposite direction acts on the object. In other words, when the robotic fountain is submerged in water, the robotic fountain becomes as light as the submerged volume thereof. When the buoyancy is equal to the weight of the robotic fountain, the robotic fountain does not float or is not submerged, and when more buoyancy is applied to the submersible buoyancy body in this state, the robotic fountain floats on the water surface.

Figure 16:
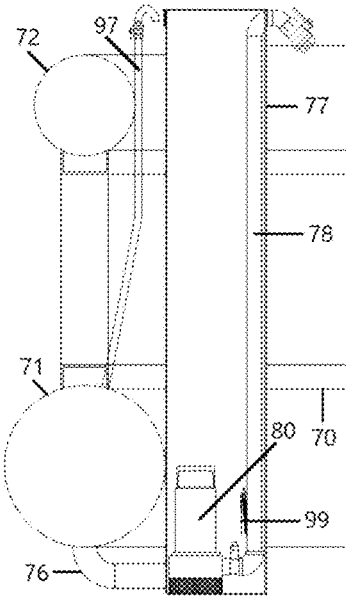
FIG. 16 is a front view showing the drain part and an air pipe of the submersible buoyancy body according to the present disclosure.

FIG. 14 is the partial 3D perspective view showing the submersible buoyancy body according to the present disclosure. FIG. 15 is the 3D perspective view showing the drain part of the submersible buoyancy body according to the present disclosure. FIG. 16 is a front view showing the drain part and the air pipe of the submersible buoyancy body according to the present disclosure.

The first end of the first drain pipe 76 is connected to a lower portion of the buoyancy pipe 71, the drain cylinder 77 is connected to the second end of the first drain pipe 76, and the drain pump 80 is positioned in the drain cylinder 77. The first end of the second drain pipe 78 positioned in the drain cylinder 77 is connected to the drain pump 80 and extends upward, and the second end of the second drain pipe 78 protrudes to the outside from the drain cylinder 77. Even when the submersible buoyancy body is submerged in water, the second end of the second drain pipe 78 is positioned outside the water, and a valve may be provided at the second end of the second drain pipe 78.

The air pipe 97 in which a first end thereof is connected to an upper portion of the buoyancy pipe 71 is formed by extending upward. Even when the submersible buoyancy body is submerged in the water, a second end of the air pipe 97 is positioned out of the water, and a second end of the air pipe 97 may have a valve.

At this time, when the drain pump 80 is operated, the drain pump 80 discharges water in the drain cylinder 77 to the outside through the second drain pipe 78, and water in the buoyancy pipe 71 flows to the drain cylinder 77 through the first drain pipe 76. Furthermore, air flows to the inside of the buoyancy pipe 71 through the air pipe 97, and the submersible buoyancy body is raised by increasing the air in the buoyancy pipe 71. When the water surface reaches a water level sensor 99 provided on the second drain pipe 78, the operation of the drain pump 80 is stopped, and the raising of the submersible buoyancy body is also stopped.

When the drain cylinder 77 is not provided, the first end of the first drain pipe 76 may be connected to the lower portion of the buoyancy pipe 71, the second end of the first drain pipe 76 may be connected to the drain pump 80, the first end of the second drain pipe 78 may be connected to the drain pump 80, and the second end of the second drain pipe 78 may extend upward. In other words, the first drain pipe 76 and the second drain pipe 78 may be coupled to each other to form the drain pipe 75, the drain pipe 75 having a first end connected to the lower end of the buoyancy pipe 71 may be formed to extend upward, and the drain pump 80 discharging the water in the buoyancy pipe 71 to the outside through the drain pipe 75 may be provided on one side of the lower portion of the drain pipe 75. Even when the submersible buoyancy body is submerged in the water, a second end of the drain pipe 75 may be positioned outside the water surface, and a valve may be provided at the second end of the drain pipe 75.

In this state, when the drain pump 80 is operated, the drain pump 80 discharges the water in the buoyancy pipe 71 to the outside through the drain pipe 75, and the air flows into the buoyancy pipe 71 through the air pipe 97. Accordingly, as the amount of air in the buoyancy pipe 71 is increased, the submersible buoyancy body is raised, and when the water surface reaches the water level sensor 99 provided on the drain pipe 75, the operation of the drain pump 80 is stopped and the raising of the submersible buoyancy body is stopped.

Figure 18:
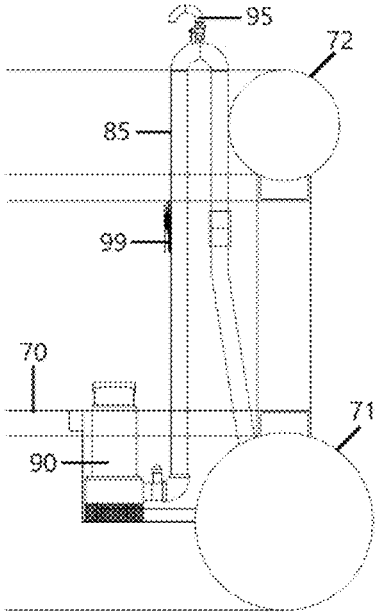
FIG. 18 is a front view showing the water supply part of the submersible buoyancy body according to the present disclosure.

FIG. 14 is the partial 3D perspective view showing the submersible buoyancy body according to the present disclosure. FIG. 17 is the 3D perspective view showing the water supply part of the submersible buoyancy body according to the present disclosure. FIG. 18 is a front view showing the water supply part of the submersible buoyancy body according to the present disclosure.

The first end of the water supply pipe 85 having the "∩" shape is connected to the upper portion of the buoyancy pipe 71. The water supply pump 90 is provided on the second end of the water supply pipe 85. The water supply pump 90 supplies water into the buoyancy pipe 71 through the water supply pipe 85.

The stop part 95 provided on the upper portion of the water supply pipe 85 having the "∩" shape stops the water supply into the buoyancy pipe 71 when the operation of the water supply pump 90 is stopped. Even when the submersible buoyancy body is submerged in the water, the stop part 95 may be positioned outside the water surface, and a valve may be provided at a second end of the stop part 95.

In this state, when the water supply pump 90 is operated, the water supply pump 90 supplies the water into the buoyancy pipe 71 through the water supply pipe 85, the air in the buoyancy pipe 71 is discharged to the outside through the air pipe 97. As the amount of the air in the buoyancy pipe 71 is reduced, the submersible buoyancy body is lowered. When the water surface reaches the water level sensor 99 provided on the water supply pipe 85, the operation of the water supply pump 90 is stopped, and the air is supplied into the upper portion of the water supply pipe 85 through the stop part 95, thereby immediately stopping the water supply into the buoyancy pipe 71 and stopping lowering of the submersible buoyancy body. When the stop part 95 is not provided, even when the operation of the water supply pump 90 is stopped, the water supply into the buoyancy pipe 71 is not immediately stopped by inertia. Accordingly, it is difficult to control the submersible buoyancy body, in other words, it is difficult to control the submersible buoyancy body in real time.

Furthermore, the stop part 95 may always be open. However, a solenoid valve is provided at the second end of the stop part 95, so that the valve may be closed when the water supply pump 90 is operated and may be opened when the operation of the water supply pump 90 is stopped. When the stop part 95 always opens, the water may be discharged through the stop part 95 when the water supply pump 90 is operated. However, the amount of water discharged through the stop part 95 may be relatively reduced by making the diameter of the stop part 95 be smaller than the diameter of the water supply pipe 85.

Functions and actions of the submersible buoyancy body according to the present disclosure will be described as follows with reference to FIGS. 13 to 18.

The robotic fountain includes the submersible buoyancy body according to the present disclosure, and the robotic fountain is positioned on the upper surface of the submersible buoyancy body and partially is submerged in the water as usual. When the drain pump 80 is operated to float the submersible buoyancy body during the operation of the robotic fountain, the drain pump 80 drains the water in the drain cylinder 77 to the outside through the second drain pipe 78, and the water in the buoyancy pipe 71 flows into the drain cylinder 77 through the first drain pipe 76, and air flows into the buoyancy pipe 71 through the air pipe 97. In this state, the amount of the air in the buoyancy pipe 71 is increased and the submersible buoyancy body is raised, causing the water surface to reach the water level sensor 99 provided on the second drain pipe 78. Accordingly, the operation of the drain pump 80 is stopped and the raising of the submersible buoyancy body is also stopped.

After the operation of the robotic fountain is completed, the water supply pump 90 is operated to allow the submersible buoyancy body to be submerged, the water supply pump 90 supplies water into the buoyancy pipe 71 through the water supply pipe 85, and the air in the buoyancy pipe 71 is discharged to the outside through the air pipe 97. In this state, is lowered as the amount of the air in the buoyancy pipe 71 is reduced, when the water surface reaches the water level sensor 99 provided on the water supply pipe 85 as lowering of the submersible buoyancy body is lowered and the amount of the air in the buoyancy pipe 71 is reduced, the operation of the water supply pump 90 is stopped and the lowering of the submersible buoyancy body is stopped. Normally, even when the operation of the water supply pump 90 is stopped, the water supply into the buoyancy pipe 71 is not immediately stopped due to inertia. However, since the stop part 95 is provided on the upper portion of the water supply pipe 85 formed in the "∩" shape, air is directly supplied to the upper portion of the water supply pipe 85 through the stop part 95 when the operation of the water supply pump 90 is stopped, so that the water supply into the buoyancy pipe 71 is immediately stopped and the lowering of the submersible buoyancy body is immediately stopped.

INDUSTRIAL APPLICABILITY

The robotic fountain according to the present disclosure can be created into variously patterned fountains, and can be raised and lowered in water by including the submersible buoyancy body.

The invention claimed is:

1. A robotic fountain comprising a main body, a rotary body rotatably positioned on an upper portion of the main body, and a nozzle configured to rotate in a direction perpendicular to a rotating direction of the rotary body, the robotic fountain comprising:

a water supply pipe configured to rotate while passing through upper and lower surfaces of the main body;

a fastening part positioned between the lower surface of the main body and a lower end of the water supply pipe, the fastening part protruding downward from the lower surface of the main body, and having a "U"-shaped section;

a first motor provided in the main body and configured to rotate the water supply pipe;

a support part provided between the upper surface of the main body and an upper end of the water supply pipe and having a "Π"-shaped section;

a bypass body fastened to the upper end of the water supply pipe and having a bypass passage communicating with the water supply pipe;

a through hole formed through one side of a lower surface of to the rotary body such that when the rotary body is fastened to an upper surface of the bypass body, the through hole communicates with the bypass passage;

an intermediate pipe configured to rotate in the rotary body and having a first end communicating with the through hole;

a second motor provided in the rotary body and connected to a second end of the intermediate pipe to rotate the intermediate pipe; and the nozzle provided in a center portion of the intermediate pipe, wherein water supplied to the water supply pipe passes through the bypass passage, the through hole, and the intermediate pipe, and is sprayed through the nozzle, a slip ring is provided on a lower outside surface of the water supply pipe, a main part having a "Π"-shaped section is provided on the upper end of the water supply pipe, a wire hole is vertically formed through the main part, the wire hole being also formed by extending to the bypass body coupled to an upper end of the main part, and being also formed by extending to the rotary body coupled to an upper end of the bypass body, wherein since wires extending from the slip ring pass through the wire hole formed on the main part, the bypass body, and the rotary body to extend into the rotary body, twisting of the wires does not occur even when the water supply pipe and the rotary body are rotated, bearings are provided between the water supply pipe and the fastening part, between the main part and the support part, and between the rotary body and the intermediate pipe, respectively at least one seal is provided on a lower portion of the bearing provided between the water supply pipe and the fastening part, at least one seal is provided on an upper portion of the bearing provided between the main part and the support part, and at least one seal is provided on one side or both sides of the bearing provided between the rotary body and the intermediate pipe, and a connection shaft coupled to the second motor is provided on the second end of the intermediate pipe.

2. The robotic fountain of claim 1, wherein a leak sensor is provided in one side in the main body or the rotary body, and the leak sensor is fastened to a "⊂"-shaped bracket.

3. The robotic fountain of claim 1, wherein a flange is formed on each of the upper end and a lower end of the bypass body.

4. The robotic fountain of claim 1, wherein the rotary body is divided into a first rotary body and a second rotary body, the intermediate pipe is positioned in the first rotary body, and the connection shaft, a reducer, and the second motor are positioned in the second rotary body.

5. The robotic fountain of claim 1, further comprising:

a submersible buoyancy body, wherein the submersible buoyancy body comprises:

a buoyancy pipe fixed to a frame;

a drain pipe connected to a lower portion of the buoyancy pipe and extending upward;

a drain pump provided on one side of a lower portion of the drain pipe and configured to drain water in the buoyancy pipe to an outside through the drain pipe;

a water supply pipe having a first end connected to an upper portion of the buoyancy pipe and having a "∩" shape;

a water supply pump provided on a second end of the water supply pipe and configured to supply water into the buoyancy pipe through the water supply pipe;

a stop part provided on an upper portion of the water supply pipe and configured to stop water supply into the buoyancy pipe when operation of the water supply pump is stopped; and an air pipe connected to the upper portion of the buoyancy pipe and extending upward.

6. The robotic fountain of claim 5, wherein an upper pipe is provided on the upper portion of the buoyancy pipe.

7. The robotic fountain of claim 5, wherein a water level sensor is provided in each of the drain pipe and the water supply pipe.

8. The robotic fountain of claim 1, further comprising:

a submersible buoyancy body, wherein the submersible buoyancy body comprises:

a buoyancy pipe fixed to a frame;

a first drain pipe having a first end connected to a lower portion of the buoyancy pipe;

a drain cylinder to which a second end of the first drain pipe is connected;

a drain pump positioned in the drain cylinder;

a second drain pipe positioned in the drain cylinder, the second drain pipe having a first end connected to the drain pump and extending upward, and a second end protruding to the outside from the drain cylinder;

a water supply pipe having a first end connected to an upper portion of the buoyancy pipe, and having a "∩" shape;

a water supply pump provided on a second end of the water supply pipe and configured to supply water into the buoyancy pipe through the water supply pipe;

a stop part provided on an upper portion of the water supply pipe and configured to stop water supply into the buoyancy pipe when operation of the water supply pump is stopped; and an air pipe connected to the upper portion of the buoyancy pipe and extending upward.

9. The robotic fountain of claim 8, wherein a water level sensor is provided in each of the second drain pipe and the water supply pipe.

* * * * *